US005170210A

United States Patent [19]

Saruwatari

[11] Patent Number: 5,170,210

[45] Date of Patent: Dec. 8, 1992

[54] IMAGE FORMING APPARATUS HAVING ENVIRONMENTAL DETECTING MEANS FOR ACHIEVING OPTIMUM IMAGE DENSITY

[75] Inventor: Ryoji Saruwatari, Yokohama, Japan

[73] Assignee: Kabushiki Kaisha Toshiba, Kawasaki, Japan

[21] Appl. No.: 73,450

[22] Filed: May 29, 1991

[30] Foreign Application Priority Data

May 31, 1990 [JP] Japan ..... 2-142018

[51] Int. Cl.[5] ..... G03G 15/00

[52] U.S. Cl. ..... 355/208; 355/204; 355/246

[58] Field of Search ..... 355/208, 214, 215, 219, 355/246, 211, 212, 69, 204, 221, 225; 346/160; 364/274.6, 275.2, 275.1

[56] References Cited

U.S. PATENT DOCUMENTS

| | | | |
|---|---|---|---|
| 4,277,162 | 7/1981 | Kasahara et al. | 355/14 R |
| 4,888,618 | 12/1989 | Ishikawa | 355/208 |
| 4,916,488 | 4/1990 | Kimura | 355/208 |
| 4,959,039 | 1/1991 | Hayashi et al. | 355/208 |
| 4,989,039 | 1/1991 | Hayashi et al. | 355/208 |
| 5,019,862 | 5/1991 | Nakamura et al. | 355/208 |
| 5,029,314 | 7/1991 | Katsumi et al. | 355/208 |

*Primary Examiner*—A. T. Grimley
*Assistant Examiner*—T. A. Dang
*Attorney, Agent, or Firm*—Foley & Lardner

[57] ABSTRACT

In an image forming apparatus, a photosensitive drum 7 is previously charged to have a surface potential by a charger 7. A latent image is formed on the charged photosensitive drum 7 by projecting an optical image thereon. The latent image is developed by a developer which is charged in the developing unit and supplied from the developing unit 18. The developed latent image is transferred to and fixed on a paper. Environmental conditions such as temperature, humidity and atmospheric pressure around the photosensitive drum are detected by temperature, humidity and pressure detectors, and image densities of the image on the photosensitive drum are detected by a density sensor. The surface potential of the drum and the charge amount of developer are charged and controlled in accordance with the image densities and the environmental conditions, so that a high quality image is formed on the paper even if environmental conditions are changed.

17 Claims, 6 Drawing Sheets

IMAGE FORMING APPARATUS HAVING ENVIRONMENTAL DETECTING MEANS FOR ACHIEVING OPTIMUM IMAGE DENSITY

BACKGROUND OF THE INVENTION

1. Field of the Invention

The present invention relates to an image forming apparatus capable of detecting the environmental conditions under which the image forming apparatus is placed and the density of images, so as to allow the image forming apparatus to form the images with an appropriate image density.

2. Description of the Related Art

It is well-known in the image forming apparatus, such as an electronic copying machine, that the density of images formed is considerably changed by environmental conditions under which the image forming apparatus is placed, that is, by temperature, humidity and atmospheric pressure around the image forming apparatus. Various kinds of measures have been employed to keep the change of this image density as small as possible. For example, environmental temperature is detected and the output of a transformer which causes an electrification charger to generate a charge is changed responsively to the temperature detected. The amount of charge added to a photosensitive drum is thus controlled and the amount of toner supplied from a developing means to the photosensitive drum is kept certain, so that the density of images can be made stable.

In the case of the conventional image forming apparatus, however, the output of the charge generating transformer is only changed by correlation with the environmental temperature. When the photosensitive drums are different in their characteristics and the amount of corona generated by the charge generating transformer is not kept certain, therefore, the amount of charge on the surface of the photosensitive drum cannot be kept certain, thereby to change the density of images formed.

SUMMARY OF THE INVENTION

The object of the present invention is therefore to provide an image forming apparatus capable of preventing the density of images formed by each of the image forming apparatuses from being changed even when an image carrying means in each of the image forming apparatuses is different in characteristics from the others and the amount of discharge is not kept the same where environmental conditions under which each of the image forming apparatuses is placed are different.

According to the present invention, an image forming apparatus comprises image forming means for forming an image as a visible image which has an image density, and the apparatus is capable of changing the image density by changing image forming parameters; density detector means for detecting the density of the visible image formed by the image forming means, to generate a density detection signal; an environmental conditions detector means for detecting environmental conditions at the time of forming the image, to generate an environmental conditions detection signal; and control means for controlling image forming parameters of the image forming means responsive to the environmental conditions detection signal applied from the environmental conditions detector means and the density detection signal applied from the density detector means.

According to the present invention, an image forming apparatus also, comprises an image forming means, including a photosensitive member, for allowing the photosensitive member to form an electrical image under various image forming conditions; detecting means for detecting environmental conditions around the image forming means, to generate a detection signal; means for applying one of image forming conditions to the image forming means in accordance with the detection signal and causing the image forming means to form image under the applied images forming conditions; and means for discriminating an acceptable quality of the formed image on the image forming means from an unacceptable quality of formed image.

According to the image forming apparatus of the present invention, a change of image density caused by changing environmental temperature is corrected to some extent, the image density is then directly detected by the density detector means and the image forming means is controlled by the control means responsive to the value thus detected, so that the density of images formed can be kept certain.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
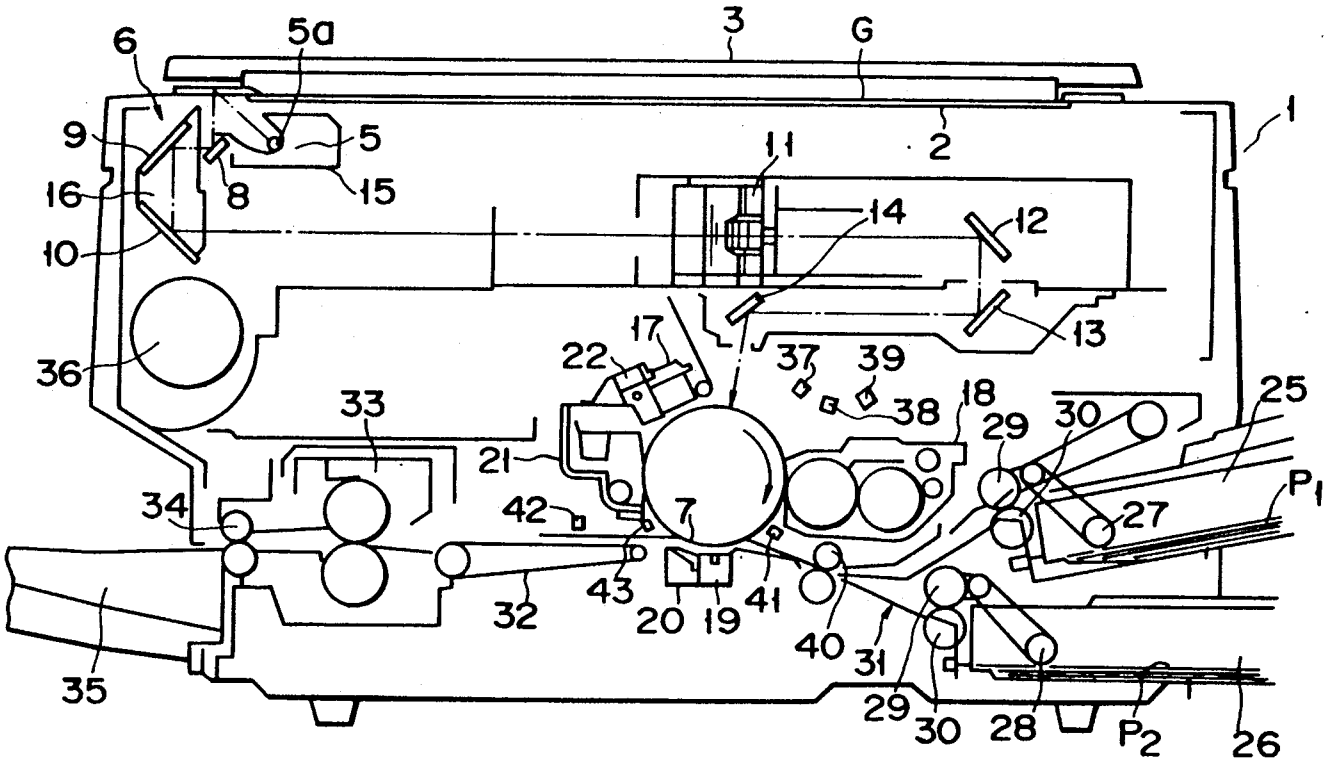
FIG. 1 schematically shows the inside structure of an electronic copying machine which is embodied as an image forming apparatus according to the present invention.

FIG. 1 shows an electronic copying machine which is embodied as an embodiment of the present invention. As shown in FIG. 1, an original holder 2 and a cover 3 for causing the original holder 2 to be exposed or opened and closed are arranged on the top of a machine body 1. A lightening section 5 for shooting light to an original G on the original holder 2 is located in the machine body 1 at the upper portion thereof. Light shot from the lightening section 5 and reflected by the original G is imaged on a photosensitive drum 7 which will be described later through an optical system 6.

The optical system 6 comprises first through third mirrors 8, 9, 10, a lens 11 and fourth through sixth mirrors 12, 13, 14. The first mirror 8 is attached to a first carriage 15 together with the lightening section 5 and the second 9 and the third mirror 10 are attached to a second carriage 16.

The first carriage 15 and the second carriage 16 are reciprocated along the length of the original holder 2. The second carriage 16 is moved at a speed half the that of the first carriage 15, in this case. The photosensitive drum 7 is located freely rotatable in the machine body 1 substantially at the center portion thereof. Located around the photosensitive drum 7 in the rotating direction thereof are: a charger 17 for electrifying the photosensitive drum 7, a developing unit 18 for developing a latent image on the photosensitive drum 7, a transfer charger 19 for transferring the image developed on the photosensitive drum 7 to a sheet of paper P1 or P2, a separation charger 20 for separating the sheet of paper from the photosensitive drum 7, a cleaner 21 for cleaning the photosensitive drum 7, and a discharger 22 for eliminating charge from the photosensitive drum 7.

First and second paper supply cassettes 25 and 26 are located on one side of the machine body 1. The sheets of paper P1 and P2 (which will be hereinafter referred to as papers P1 and P2) in the first and second paper supply cassettes 25 and 26 are picked up one by one by a pickup rollers 27 and 28. The paper P1 or P2 picked up is fed onto a paper conveying passage 31 through paper supplying and separating rollers 29 and 30 which are rotated while contacting each other. Located on the paper conveying passage 31 along a direction in which the papers are conveyed there are resist rollers 40 for aligning the papers, transferring and separation chargers 19, 20, a paper conveying belt 32, a means 33 for fixing images transferred on the papers, and discharge rollers 34 for discharging the papers outside the machine body 1. Reference numeral 35 denotes a tray in which the papers discharged are received, and reference numeral 36 represents an exhausting fan.

A detector 37 for detecting the temperature in the machine body 1, another detector 38 for detecting humidity in the machine body 1 and a further detector 39 for detecting atmospheric pressure in the machine body 1 are located on the top side of the developing unit 18. A first detector 41 for detecting densities of images formed on the photosensitive drum 7 is located on the bottom side of the developing unit 18, a second detector 42 for detecting densities of images transferred on the papers P1 and P2 is located on the top side of the conveying belt 32, and a third detector 43 for detecting the density of an image on the photosensitive drum 7 after the previous image on it is transferred onto the paper P1 or P2 is located on the bottom side of the cleaning means 21.

Figure 2:
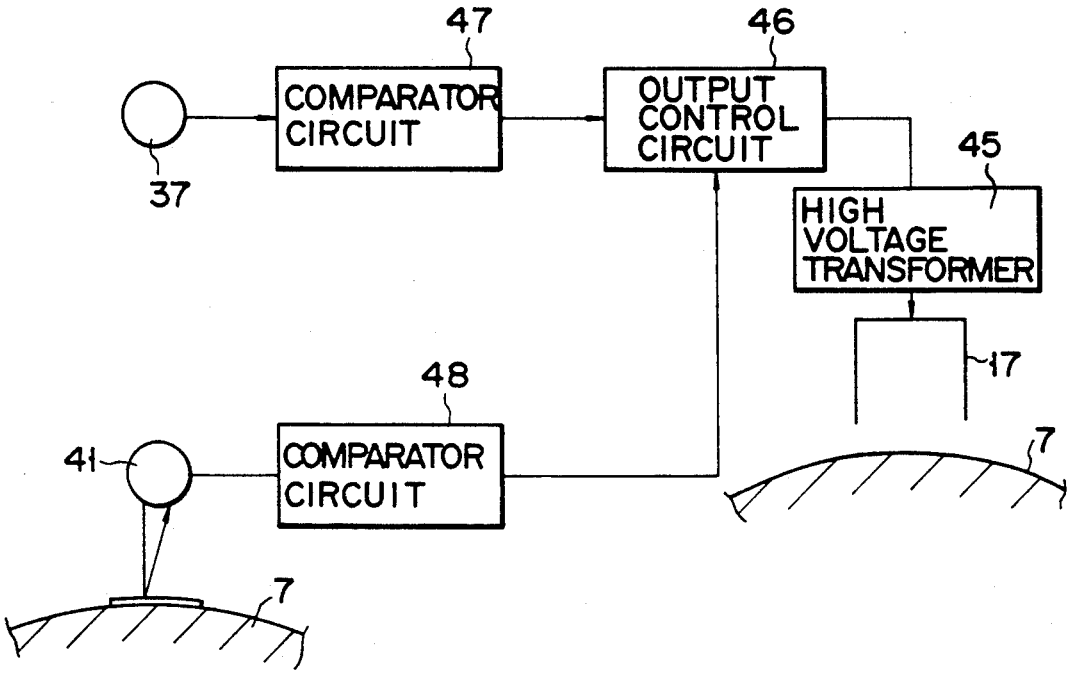
FIG. 2 is a block diagram showing a control system for the electrification charger shown in FIG. 1.

As shown in FIG. 2, a high voltage generating transformer 45 for energizing the charger 17 is connected to the temperature detector 37 via a comparator circuit 47 and an output control circuit 46. The first density detector 41 is connected to the output control circuit 46 via a comparator circuit 48. Relating to the first and second density detectors 41 and 42 and the control of both of toner density and the high voltage transformer responsive to signals applied from these detectors, please see U.S. Pat. No. 4,277,162 (Kusahara et. al). Further, relating to the control of toner density, please see U.S. Pat. No. 4,277,162.

In the case of the electronic copying machine shown in FIG. 1, light is shot from an exposing lamp 5*a* to the original G on the original holder 2 when a latent image is to be formed on the photosensitive drum 7. The light thus shot is reflected by the original G and introduced to the lens 11 through the first to the third mirrors 8, 9 and 10. After passed through the lens 11, this light is imaged on the photosensitive drum 7 through the fourth to the sixth mirrors 12, 13 and 14. The surface of the photosensitive drum 7 is previously charged by the charger 7 and an electrostatic latent image is formed on the photosensitive drum 7 by the imaging of the light. This electrostatic latent image is developed by the developer 18. On the other hand, papers P1 or P2 in the upper of lower paper supply cassette 25 or 26 are separated one by one by the separating roller 30 and fed to the resist rollers 40. The paper P1 (or P2) which has been aligned by the resist roller 40 is fed between the photosensitive drum 7 and the transfer charger 19. The image developed on the photosensitive drum 7 is transferred onto the paper P1 (or P2) by the transfer charger 19. The paper P1 (or P2) is the peeled or separated from the photosensitive drum 7 by the separating charger 20 and fed onto the conveying belt 32. The paper P1 (or P2) is fed to the fixing means 33 by the conveying belt 32 and the image on the paper P1 (or P2) is fixed by the fixing means 33. The paper P1 (or P2) on which the image has been fixed is then discharged in the paper discharge tray 36 by the paper discharging rollers 34.

Toner left on the photosensitive drum 7 after the transferring of the image onto the paper is removed from the photosensitive drum 7 by the cleaning means 21. The charge of the photosensitive drum 7 is eliminated by the charge eliminating charger 22 and the photosensitive drum 7 is again charged by the charger 17 to become ready for a next image forming process.

Figure 3A:
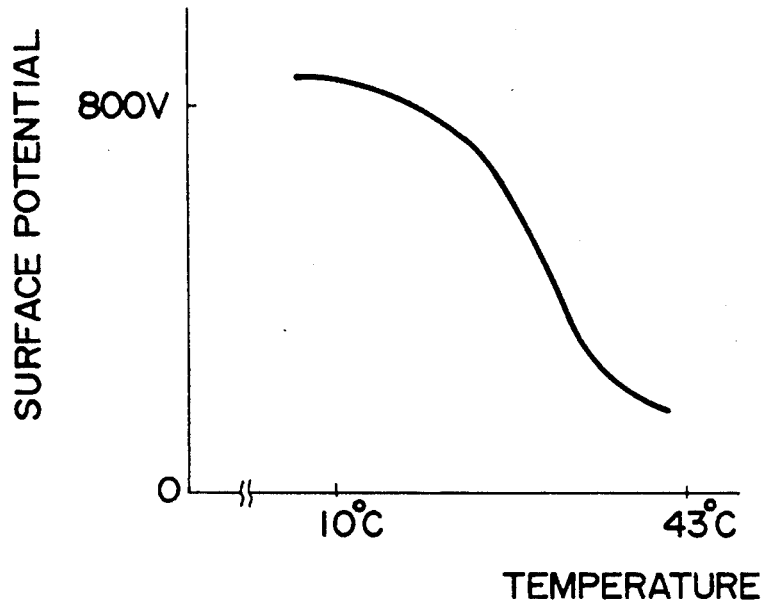
FIGS. 3A through 3F are graphs showing how control parameters change when images are formed under various environmental conditions.
Figure 3B:
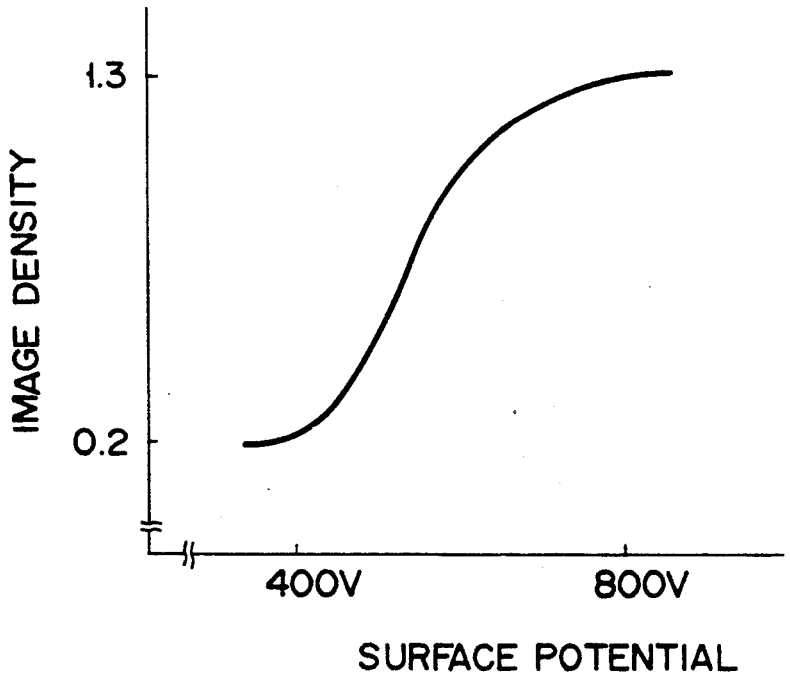
Figure 3C:
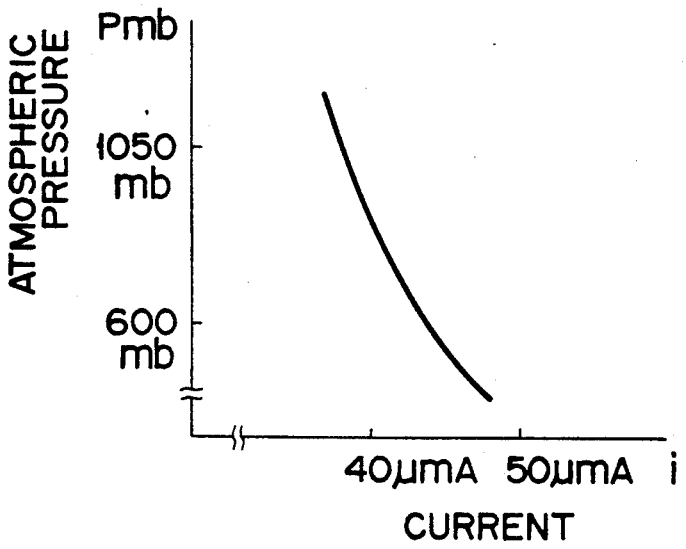
Figure 3D:
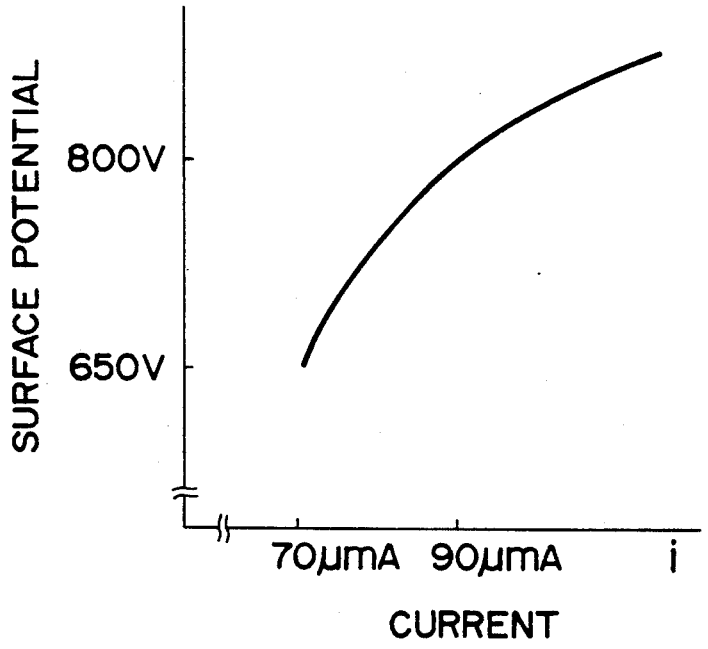
Figure 3E:
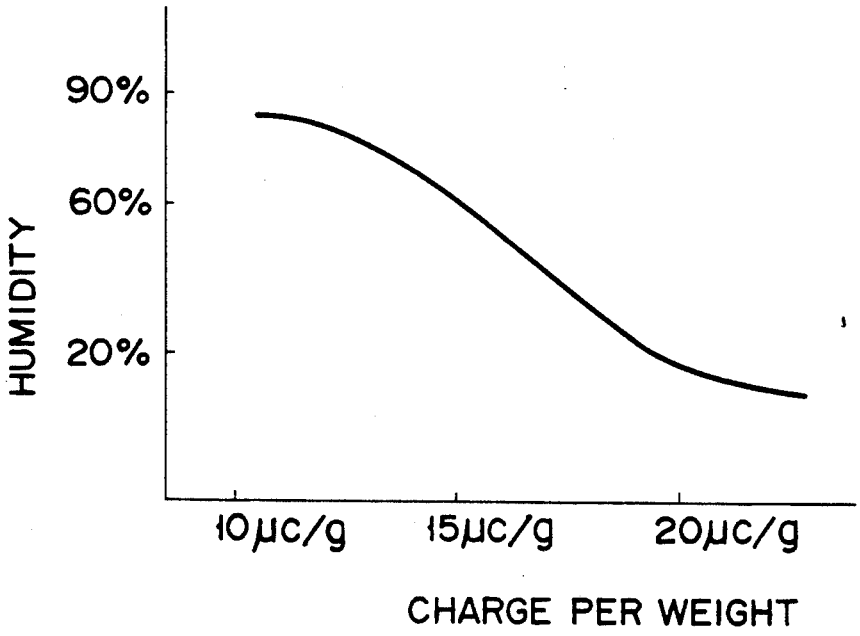
Figure 3F:
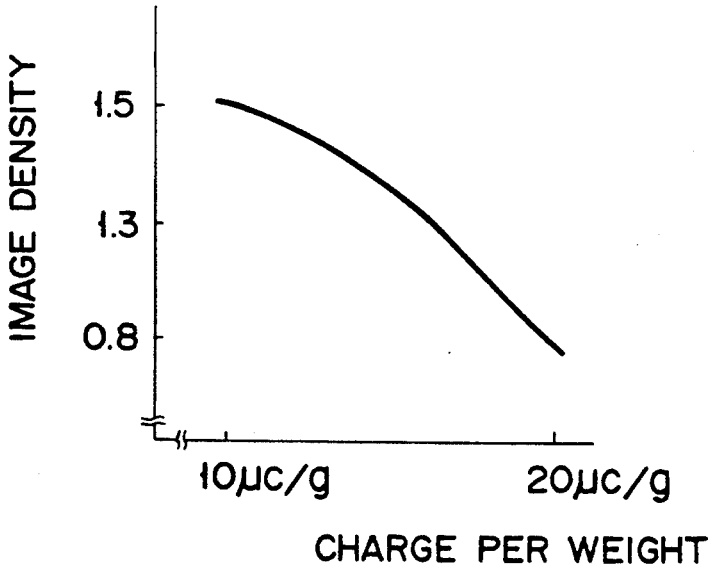

The density of the formed images changes during the image forming process, depending upon environmental conditions, including the aging of the developer and the photosensitive drum, as well as the temperature, humidity and atmospheric pressure under which the electronic copying machine is placed. But, when these environmental conditions are detected and these control parameters which determine the density of images are adjusted responsive to detected, signals the density of the images can be kept substantially certain. One of these environmental conditions which affects the density of images most severely is temperature. The value of current applied from the high voltage transformer 45 to the charger 17 is, therefore, determined by the temperature detected. As shown in FIG. 3A, the potential on the surface of the photosensitive drum 7 is lowered when temperature rises but it is raised when temperature lowers. As shown in FIG. 3B, the density of images is lowered when the surface potential of the photosensitive drum 7 lowers but it is raised when the surface potential rises. It is therefore needed that the surface potential of the photosensitive drum is kept appropriate in response to temperature detected, and in order to keep the surface potential at a predetermined value, current applied to the charger 17 is controlled to add a certain charge to the photosensitive drum 7. The value of current applied to the charger 17 is corrected on the basis of atmospheric pressure detected. Namely, corona discharge generated between the charger 17 and the photosensitive drum 7 depends upon atmospheric pressure, as shown in FIG. 3C. When atmospheric pressure is high, current flowing due to corona discharge is decreased and when it is low, the current is increased. As shown in FIG. 3D, correlation exists between the current flowing at the time of corona discharge and the surface potential of the photosensitive drum 7. Current applied to the photosensitive drum 7 due to corona discharge is therefore changed responsive to atmospheric pressure detected to keep the surface potential of the drum 7 substantially certain. Further, the density of the developer in the developing unit 18 is controlled mainly on the basis of humidity detected. Namely, toner is charged while being stirred in the developing unit 18 and the extent to which the toner is charged depends upon humidity detected, is shown in FIG. 3E. As humidity becomes higher and higher, the amount of toner charge is decreased and as it becomes lower and lower, the amount of toner charge is increased. On the contrary, the density of images is made higher as the amount of toner charge becomes lower and lower and it is made lower as the amount of toner charge becomes higher and higher, as shown in FIG. 3F. The amount of toner charge depends upon the amount of toner stirred in the developing unit 18. As humidity becomes higher and higher, therefore, the supply of toner is decreased to make the density of toner lower. As the humidity becomes lower and lower, the supply of toner is increased to make the density of the toner higher, so that the density of the images can be adjusted accordingly. Needless to say, the amount of toner charge determined mainly by humidity is influenced by temperature. Therefore, the amount of toner determined to be supplied to the developing unit 18 by humidity is corrected by temperature detected. Graphs shown in FIGS. 3A through 3F are formed using the photosensitive drum 7 made of selenium.

Figure 4:
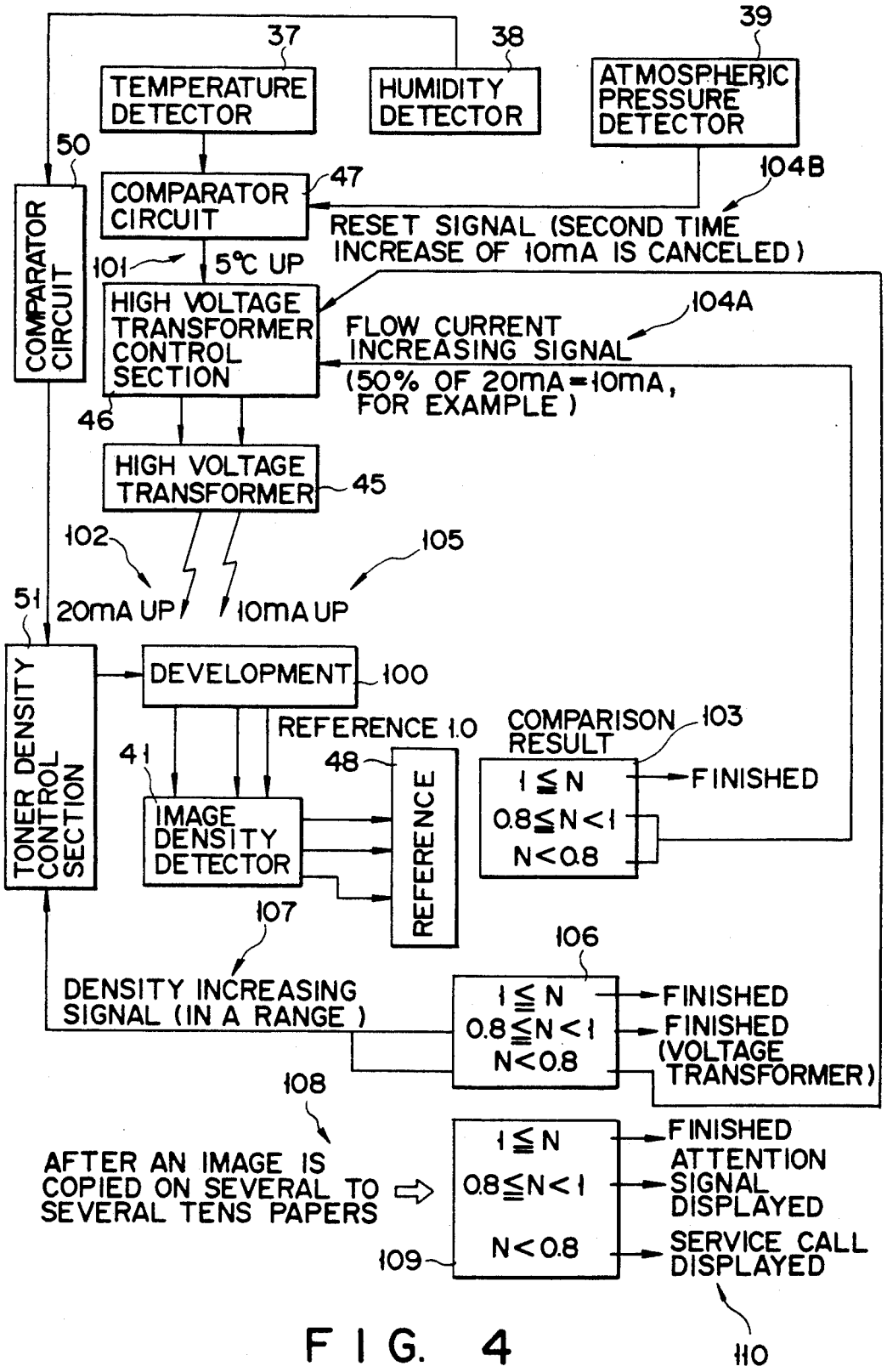
FIG. 4 explains how image forming operation is controlled depending upon environmental conditions under which the image forming apparatus is placed.

It will be described how the surface potential of the photosensitive drum 7 and the amount of toner supplied to the developing unit 18 are controlled in response to environmental conditions. Environmental temperature is detected by the temperature detector 37 and the density of images on the photosensitive drum 7 is detected by the first density detector 41. Responsive to values thus detected, the amount of charge added to the photosensitive drum 7 is controlled. In a case of the electronic copying machine wherein the density of images developed on the photosensitive drum 7 is set to be 1.0 when the value of current flowing from the high pressure transformer 45 to the photosensitive drum 7 is 100mA and the toner density of developer in the developing unit 18 is 5% at an environmental temperature of 25° C., for example, the density of images is controlled according to such a process as shown in FIG. 4 to stably become 1.0 in a range of temperature.

As already described above, it is supposed that the surface potential of the photosensitive drum 7 is lowered when environmental temperature rises, that the density of images is lowered when the surface potential of the photosensitive drum 7 decreases, and that the density of images is also lowered when the density of toner in the developing unit 18 decreases. In addition, it is assumed that it has been almost confirmed that the density of images becomes 1.0 due to the characteristic of the photosensitive drum 7, providing that the toner density be 5%, when the value of current applied from the high pressure transformer 45 is increased by 20mA in a case where the environmental temperature rises from 25° C. to 30° C., for example. It is also assumed that the density of images is 0.6 when the value of current is not increased.

When an environmental temperature is detected by the temperature detector 37 and it is found by the comparator circuit 47 that the temperature detected rises by 5° C. higher than its reference temperature, as shown at a step 101, the high voltage transformer control section 46 causes the current value of the high pressure transformer 45 to be increased by 20mA, as shown at a step 102. An image is developed on the photosensitive drum 7, as shown at a step 100, and the density of the image on the photosensitive drum 7 is detected by the detector 41. This value N detected is compared with a reference value 1 by the comparator circuit 48 and when $1 \leqq N$ as shown at a step 103, the detection of image density is finished, as shown at a step 103. But when $0.8 \leqq N < 1$ or $N < 0.8$, signal for asking the high pressure transformer control section 46 to increase the value of current applied from the high voltage transformer 45 is sent to the section 46, as shown at a step 104A, and the value of current applied from the high pressure transformer 45 is increased by 10mA, for example, as shown at a step 105.

The density of the image on the photosensitive drum 7 is again detected by the image density detector 41. This value N detected is compared with the reference value 1 and when $1 \leqq N$, the detection of image density is finished, as shown at the step 103. But when $0.8 \leqq N < 1$, the adjustment of current applied from the high pressure transformer 45 is finished and when $N < 0.8$, reset signal is sent to the high pressure transformer control section 46 to cancel the second time increase of 10mA, as shown at a step 104B.

When $0.8 \leqq N < 1$ or $N < 0.8$ this time, as shown at a step 106, the signal for asking a toner density control section 51 to raise the toner density is sent to the section 51, as shown at a step 107. The toner density control section 51 is thus made operative to raise the toner density and the latent image on the photosensitive drum 7 is developed, as shown at the step 100, and the density of the image is detected by the image density detector 41. After the image is copied on several or several tens of papers, as shown at step 108, the value N detected is compared with the reference value 1 by the comparator circuit 48, as shown at a step 109. When $1 \leqq N$, the control of toner density is finished. But when $0.8 \leqq N < 1$ or $N < 0.8$, attention signal is displayed on a display section (not shown) and when $N < 0.8$, service call is displayed, as shown at a step 110.

In a case where humidity is detected by the humidity detector 38, the humidity which is represented by detection signal applied from the humidity detector 38 is compared with a reference humidity by a comparator 50 and the value thus obtained is applied to the toner density control section 51. When the humidity detected is higher than the reference humidity, the control section 51 decreases the amount of toner supplied to the developing means 18 and when it is lower, the section 51 increases the amount of toner supplied to the developing unit 18. When the amount of toner supplied to the developing unit 1 is thus controlled. The density of image is changed but this change of the image density is controlled by the same process as the one by which the density of the images is controlled on the basis of the temperature detection signal, referring to FIG. 3A. The density of the images determined by controlling temperature can, thus, be adjusted. In a case where the atmospheric pressure is detected by the atmospheric pressure detector, the atmospheric pressure thus detected is compared with its reference atmospheric pressure by the comparator 51 and the result thus obtained is sent to the high pressure transformer control section 46. This result obtained relating to atmospheric pressure is applied to the control section 46 as a additional condition for the result obtained relating to temperature. The control section 46 therefore controls the surface potential of the photosensitive drum and the toner density on the basis of the result obtained relating to atmospheric pressure, similarly to the case where the density of images is controlled on the basis of temperature while referring to FIG. 3A. The density of images determined by controlling temperature can, thus, be adjusted Although the high voltage transformer control section 46 has controlled the high pressure transformer 45 responsive to detection signal applied from the first image density detector 41 and the toner density control section 51 has controlled the amount of developer supplied to the developing unit 18 at the control process prepared by referring to FIGS. 3A through 3F, control parameters may be corrected responsive to detection signals applied from the second and third density detectors 42 and 43 according to the same process as the one shown in FIG. 4. More specifically, it may be arranged .that weight is added to detection signals applied from the first, second and third density detectors 41, 42 and 43, that an average value is obtained from these weight-added detection signals to get the value of detection density, that this detection density value is compared with its reference value by the comparator circuit 48, and that the result thus obtained i used to determine control parameters.

As described above, environmental temperature is detected, the value thus detected is compared with its reference value and the output of the electrification charger 17 is controlled responsive to the value thus obtained by this comparison by means of the output control section 46 to make the amount of charge on the surface of the photosensitive drum 7 substantially certain. The density of image is then practically detected by the first density detector 41, the value thus detected is compared with its reference value by the comparator circuit 48 and the output of the electrification charger 17 is again controlled responsive to the value thus obtained by this comparison by means of the output control section 46 to correct the amount of charge on the surface of the photosensitive drum 7. Even when the charge characteristic of the photosensitive drum 7 and the amount of discharge created by the electrification charger 17 are not kept certain, therefore, the density of images can be made stable with a higher accuracy.

As described above, image forming conditions are controlled according to environmental conditions under which the electronic copying machine is used so as to form an image, the density of this image is then detected by the density detector and the image forming conditions are again controlled responsive to the value thus detected. Even when the charge characteristic of the images carrying body and the amount of discharge created by the electrification charger are not kept certain, therefore, the density of images can be made stable with a higher accuracy.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

image forming means for forming an image as a visible image which has an image density and capable of changing the image density by changing image forming parameters;

density detector means for detecting the density of the visible image formed by the image forming means to generate a density detection signal;

environmental condition detector means for detecting environmental conditions to generate an environmental condition detection signal; and control means for controlling image forming parameters of the image forming means responsive to the environmental condition detection signal received from the environmental condition detector means and the density detection signal received from the density detector means to cause said image forming means to form another image having a density which is within a predetermined allowable density range.

2. The image forming apparatus according to claim 1, wherein said environmental condition detector means includes detector means for detecting temperature around the image forming means.

3. The image forming apparatus according to claim 1, wherein said environmental condition detector means includes detector means for detecting humidity around the image forming means.

4. The image forming apparatus according to claim 1, wherein said environmental condition detector means includes detector means for detecting atmospheric pressure around the image forming means.

5. The image forming apparatus according to claim 1, wherein said image forming means includes means for developing the image with a developer to form the visible image and means for supplying the developer, and said control means includes means for energizing the supply means to adjust the developing means in response to the environmental condition detection signal and the density detection signal.

6. An image forming apparatus comprising:

image forming means, including a photosensitive member, for allowing the photosensitive member to form an electrical image under various image forming conditions;

detecting means for detecting an environmental condition in a space around said image forming means and generating a detection signal;

means for changing one of the image forming conditions in accordance with the detection signal, and causing said image forming means to form the image under the changed image forming condition and the other image forming conditions; and means for determining a proper quality of the formed image on said image forming means from an improper quality of the formed image to cause the changing means to change the image forming condition.

7. The image forming apparatus according to claim 6, wherein said detecting means includes detector means for detecting temperature around the image forming means.

8. The image forming apparatus according to claim 6, wherein said detecting means includes detector means for detecting humidity around the image forming means.

9. The image forming apparatus according to claim 6, wherein said detecting means includes detector means for detecting atmospheric pressure around the image forming means.

10. The image forming apparatus according to claim 6, wherein said image forming means includes means for developing the image with a developer to form the visible image and means for supplying the developer and said control means includes means for energizing the supply means to adjust the developing means in response to the environmental condition detection signal and the density detection signal.

11. An image forming apparatus comprising:

image forming means, including a photosensitive member, for allowing the photosensitive member to form an electrical image under various image forming conditions;

first detecting means for detecting a first environmental condition in a space in which said image forming means are arranged, to generate a first detection signal;

second detecting means for detecting a second environmental condition different from the first environmental condition in a space in which said image forming means are arranged, to generate a second detection signal;

means for changing at least one of the image forming conditions in accordance with the first detection signal, and causing said image forming means to form the image under the changed image forming condition and the other image forming conditions;

third detecting means for detecting a quality of the formed image on said image forming means and generating a third detection signal when the detected quality of the image is outside of an allowable range; and means for causing said changing means to change the image forming condition to another one which is determined in accordance with the second detection signal, based on the third detection signal.

12. The image forming apparatus according to claim 11, wherein one of said first detecting means and second detecting means includes detector means for detecting temperature around the image forming means.

13. The image forming apparatus according to claim 11, wherein one of said first detecting means and second detecting means includes detector means for detecting humidity around the image forming means.

14. The image forming apparatus according to claim 11, wherein said detecting means includes detector means for detecting atmospheric pressure around the image forming means.

15. The image forming apparatus according to claim 11, wherein said image forming means includes means for developing the image with a developer to form the visible image and means for supplying the developer and said control means includes means for energizing the supply mean to adjust the developing means in response to the environmental condition detection signal and the density detection signal.

16. The image forming apparatus according to claim 11, wherein said applying means applies another one of forming conditions to said image forming means in accordance with the first detection signal and causing said image forming means to form another image under another image forming condition and third detecting means detecting a quality of another image and generates the third detection signal when another image is out of an allowable range.

17. The image forming apparatus according to claim 11, wherein said causing means causes said applying means to change another image forming condition to the one of the image forming conditions which is determined in accordance with the first detection signal, based on the third detection signal.

* * * * *

UNITED STATES PATENT AND TRADEMARK OFFICE

CERTIFICATE OF CORRECTION

PATENT NO. : 5,170,210

DATED : December 8, 1992

INVENTOR(S) : Ryoji SARUWATARI

It is certified that error appears in the above-identified patent and that said Letters Patent is hereby corrected as shown below:

On the title page: Item

[21] Please change "73,450" to --707,345--.

Signed and Sealed this

First Day of March, 1994

Bruce Lehman

BRUCE LEHMAN

*Commissioner of Patents and Trademarks*

*Attest:*

*Attesting Officer*